US005666865A

United States Patent [19]

Ito

[11] Patent Number: 5,666,865

[45] Date of Patent: Sep. 16, 1997

[54] FUSE PULLER

[75] Inventor: Hirokazu Ito, Yokkaichi, Japan

[73] Assignee: Sumitomo Wiring Systems, Ltd., Yokkaichi, Japan

[21] Appl. No.: 547,192

[22] Filed: Oct. 24, 1995

[30] Foreign Application Priority Data

Nov. 2, 1994 [JP] Japan ..... 6-269764
Nov. 2, 1994 [JP] Japan ..... 6-269767

[51] Int. Cl.[6] ..... B25B 27/14

[52] U.S. Cl. ..... 81/3.8; 294/99.2; 29/278

[58] Field of Search ..... 81/3.8, 176.15–176.3; 294/99.1, 99.2; 29/278, 739, 758, 754

[56] References Cited

U.S. PATENT DOCUMENTS

| | | | |
|---|---|---|---|
| 1,363,515 | 12/1920 | Knoss, Jr. | 81/3.8 |
| 3,253,327 | 5/1966 | McElligatt | 29/278 X |
| 3,906,957 | 9/1975 | Weston | 294/99.2 X |
| 4,079,765 | 3/1978 | Hatayan | 294/99.2 X |
| 4,128,024 | 12/1978 | Hyams et al. | 81/3.8 |
| 4,212,305 | 7/1980 | Lahay | 294/99.2 X |
| 4,330,936 | 5/1982 | Swarth | 294/99.2 X |
| 4,475,283 | 10/1984 | Olson et al. . | |
| 4,541,311 | 9/1985 | Trammell, Jr. | 81/3.8 |
| 5,044,058 | 9/1991 | Voss | 29/278 |
| 5,267,493 | 12/1993 | Yamagata et al. . | |

FOREIGN PATENT DOCUMENTS 0348871 1/1990 European Pat. Off. .

OTHER PUBLICATIONS

Buss® Fuse Puller, Bussmann Division, McGraw–Edison Co., Catalog NO. BP/FP–C, Feb. 2, 1984.

*Primary Examiner*—D. S. Meislin
*Attorney, Agent, or Firm*—Greenblum & Bernstein, P.L.C.

[57] ABSTRACT

A fuse puller for pulling a fuse out of a fuse mounting portion, comprising: a pair of elongated platelike arms; an elastic coupling beam for coupling longitudinally intermediate portions of the arms with each other such that the arms are longitudinally divided into a fuse engageable portion and a grip of the fuse puller by the coupling beam; and a claw member which projects from one end of an inner face of each of the arms at the fuse engageable portion so as to be brought into engagement with the fuse; wherein a first width of the arms at the grip is set smaller than a second width of the arms at the fuse engageable portion.

3 Claims, 10 Drawing Sheets

FUSE PULLER

BACKGROUND OF THE INVENTION

The present invention generally relates to fuse pullers and more particularly, to a fuse puller which enables a fuse inserted into a fuse mounting portion of an electrical connection box such as a fuse box to be pulled out of the fuse mounting portion smoothly.

Conventionally, fuse pullers are integrally molded by injecting resin into a molding die. As shown in FIG. 1, a known fuse puller 50 includes a pair of arms 51 coupled with each other at their intermediate portions by a coupling beam 52 and two pairs of claws 54 and 55 for gripping a fuse, which project from an inner face of one end portion of each of the arms 51.

In case the fuse is pulled out of a fuse mounting portion of a fuse box, etc., a pair of grips 59 disposed at the other end portion of each of the arms 51 are grasped so as to separate the claws 54 and 55 away from each other with the coupling beam 52 as a fulcrum. In this state, the claws 54 and 55 are, respectively, brought into engagement with four slots 61 formed at opposite sides on each of opposite faces of a fuse body 62 of a fuse 60 as shown in FIGS. 2 and 3. Then, by releasing the grips 59 from grasp and pulling the grips 59 in a direction for pulling the fuse 60 out of the fuse mounting portion, the fuse 60 is pulled out of the fuse mounting portion.

However, when the fuse 60 is pulled out of the fuse mounting portion by holding the grips 59, there is a risk that by strongly holding the grips 59, the claws 54 and 55 are separated away from each other so as to be brought out of engagement with the slots 61, so that the fuse 60 falls off the fuse puller 50 undesirably. Therefore, in order to obviate this risk when the fuse 60 is pulled out of the fuse mounting portion, a portion of the fuse puller 50, which is disposed at the coupling beam 52, or a portion of the fuse puller 50, which deviates towards the claws 54 and 55 from the coupling beam 52, i.e., the arms 51 is grasped frequently such that the claws 54 and 55 are positively prevented from being separated away from each other.

In response to recent demand for higher density and more compact size of a rectangular electrical connection box 30 such as a fuse box, fuse mounting portions 31 are frequently disposed at four corners of a side wall 32 of the electrical connection box 30 as shown in FIG. 4. Especially, in a fuse box installed in an engine room, etc., since the side wall 32 is formed high for waterproofing, merely small gaps s1 and s2 exist between the high side wall 32 and the fuse puller 50 at a fuse mounting portion 31' disposed at one of the corners of the fuse box. In case the fuse 60 is pulled out of the fuse mounting portion 31' by using the fuse puller 50, an operator cannot easily insert his finger into the gaps s1 and s2 and thus, it is extremely difficult to pull the fuse 60 out of the fuse mounting portion 31' by using the fuse puller 50.

Especially, when the fuse puller 50 is pulled outwardly after the claws 54 and 55 of the fuse puller 50 have been brought into engagement with the slots 61 of the fuse 60, it is impossible to insert the finger into the gap s1 due to its small dimension in order to grasp the portion of the fuse puller 60 disposed at the coupling beam 52 or deviating towards the claws 54 and 55 from the coupling beam 52. As a result, since the operator is forced to grasp the grips 59 of the fuse puller 50, such a problem arises that when the operator grasps the grips 59 too strongly, the claws 54 and 55 are separated away from each other so as to be brought out of engagement with the slots 61 of the fuse 60 and thus, the fuse 60 falls off the fuse puller 50 undesirably.

As described above, in the known fuse puller 50, a total of the four claws 54 and 55 project from the inner face of the one end portion of each of the arms 51 so as to be, respectively, brought into engagement with a total of the four slots 61 formed at opposite sides on each of the opposite faces of the fuse body 62 of the fuse 60. In case the claws 54 and 55 are projected from the inner face of the one end portion of each of the arms 51, a molding die 65 for forming the fuse puller 50 includes a pair of split dies 66 separated from each other along a parting line S' corresponding to a lateral center of the arms 51 as shown in FIG. 5. Therefore, the claws 54 and 55 projecting from the opposite sides of each of the arms 51 prevent the split dies 66 from separated from each other along the one-dot chain line in FIG. 5 so as to be released from each other in the directions of the arrows A. Accordingly, a central sliding die 68 for forming a region of the fuse puller 50 interposed between the arms 51 is required to be provided.

In case the central sliding die 68 should be provided for the molding die 65, productivity drops due to long molding time and production cost of the molding die rises. Moreover, disassembly and assembly of the molding die are time-consuming and troublesome.

SUMMARY OF THE INVENTION

Accordingly, a first object of the present invention is to provide, with a view to eliminating the above mentioned drawbacks of conventional fuse pullers, a fuse puller which enables a fuse to be pulled out of a fuse mounting portion easily and positively even when only a small space is available.

A second object of the present invention is to provide a fuse puller which can be produced by using only a pair of split dies without the need for a central sliding die.

In order to accomplish the first object of the present invention, a fuse puller for pulling a fuse out of a fuse mounting portion, according to the present invention comprises: a pair of elongated platelike arms; an elastic coupling beam for coupling longitudinally intermediate portions of the arms with each other such that the arms are longitudinally divided into a fuse engageable portion and a grip of the fuse puller by the coupling beam; and a claw member which projects from one end of an inner face of each of the arms at the fuse engageable portion so as to be brought into engagement with the fuse; wherein a first width of the arms at the grip is set smaller than a second width of the arms at the fuse engageable portion.

In the fuse puller, opposite outer faces of the arms at the grip, which have the first width, are grasped and depressed towards each other such that the claws at the fuse engageable portion are separated away from each other with the coupling beam as a fulcrum. Thus, the claws are brought into engagement with slots of the fuse, respectively. Then, by releasing the grip from depression, the claws are held in engagement with the slots of the fuse, respectively. Subsequently, by shifting fingers so as to clip opposite side faces of the arms at the grip, the fuse puller is pulled outwardly so as to pull the fuse out of the fuse mounting portion.

At this time, since the first width of the arms at the grip is made small, gap between the grip and a side wall of a fuse box can be increased. Therefore, an operator depresses the opposite outer faces of the arms at the grip so as to separate the claws away from each other such that the claws are brought into engagement with the slots of the fuse, respectively. Thereafter, in order to pull the fuse puller outwardly, the opposite side faces of the arms at the grip, which are spaced the first width of the arms from each other, are clipped by shifting fingers. Thus, fingers can be inserted into the gap between the grip and the side wall of the fuse box. Furthermore, even if the opposite side faces of the arms at the grip are grasped and pulled outwardly strongly, force is applied to the arms at the grip in a direction orthogonal to a direction for separating the claws away from each other and thus, the fuse puller is not disengaged from the fuse through separation of the claws away from each other. Accordingly, since the fuse does not fall off the fuse puller, the fuse can be positively pulled out of the fuse mounting portion.

It is needless to say that the fuse puller can also be used for inserting the fuse into the fuse mounting portion in a state where the fuse puller is held in engagement with the fuse.

Meanwhile, in order to accomplish the second object of the present invention, a fuse puller for pulling a fuse out of a fuse mounting portion, which is integrally molded by resin, according to the present invention comprises: a pair of elongated platelike arms; an elastic coupling beam for coupling longitudinally intermediate portions of the arms with each other; a first claw which projects from one side of one end of an inner face of one of the arms so as to be brought into engagement with the fuse; and a second claw which projects from the other side of one end of an inner face of the other of the arms so as to be brought into engagement with the fuse such that the first and second claws are disposed diagonally to each other on the arms.

In the fuse puller, the first claw is provided at one side of one end of the inner face of one of the arms and the second claw is provided at the other side of the inner face of the other of the arms such that the first and second claws are disposed diagonally to each other on the arms. Therefore, a molding die used for integral molding of the fuse puller can be formed by only a pair of split dies and thus, a hitherto necessary sliding die is not required to be employed for the molding die.

In the fuse puller, only two claws are provided but the two claws are disposed diagonally to each other. Therefore, the fuse puller can be pulled outwardly stably upon engagement of the claws with the slots of the fuse.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
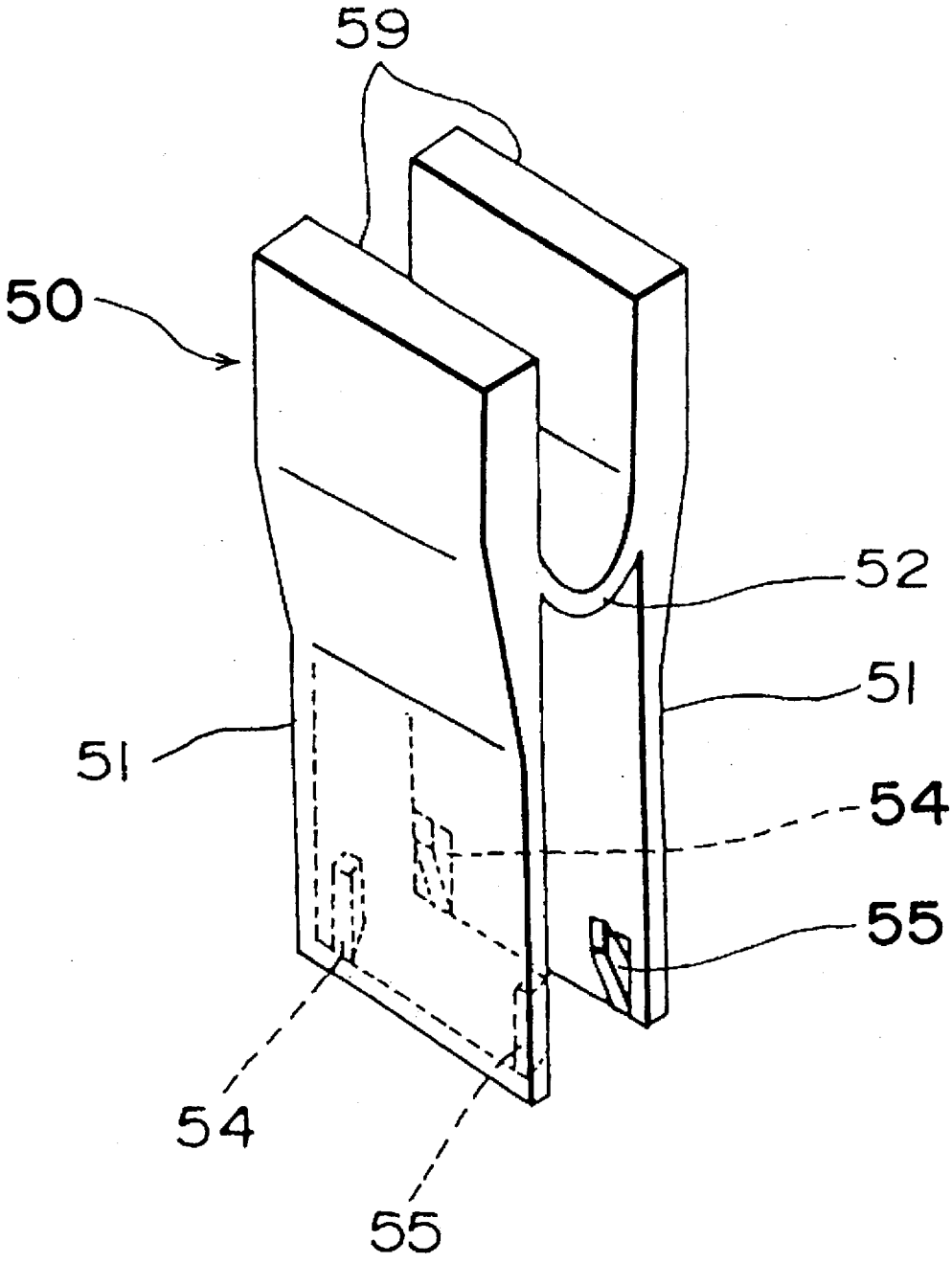
Fig. 1 PRIOR ART
FIG. 1 is a perspective view of a prior art fuse puller (already referred to)
Figure 2:
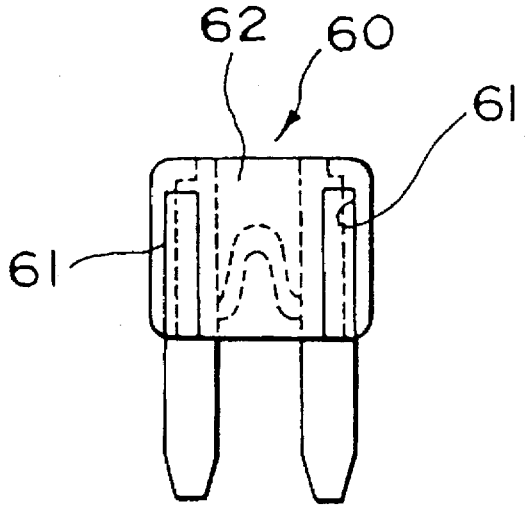
Fig. 2 PRIOR ART
FIGS. 2 and 3 are a front elevational view and a side elevational view of a prior art fuse, respectively (already referred to)
Figure 3:
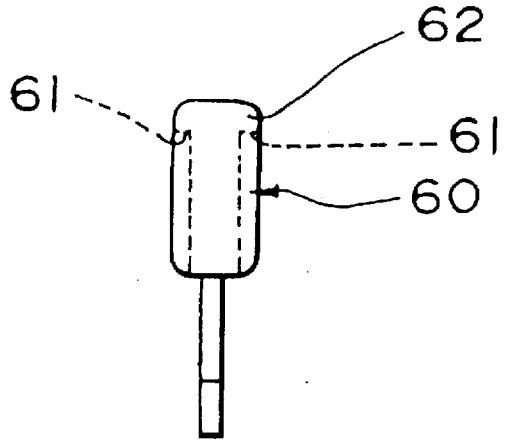
Fig. 3 PRIOR ART

Referring now to the drawings, there is shown in FIGS. 6 to 10, a fuse puller K1 according to a first embodiment of the present invention. The fuse puller K1 is formed by integral molding of resin and includes a pair of arms 2 each formed by an elongated plate and an elastic coupling beam 4 for coupling longitudinally intermediate portions of the arms 2 with each other. The arms 2 are longitudinally divided into a fuse engageable portion 9 and a grip 10 of the fuse puller K1 by the coupling beam 4. The fuse puller K1 further includes a rib 7 which extends at a lateral center of an inner face of each of the arms 2 from an inner peripheral surface of the coupling beam 4 towards the fuse engageable portion 9 so as to bridge the arms 2.

The fuse engageable portion 9 includes two pairs of claws 5 and 6 for gripping a fuse 25, which project from one end of an inner face of each of the arms 2 at the fuse engageable portion 9. Each of the arms 2 is laterally expanded obliquely outwardly at a predetermined angle towards the fuse engageable portion 9 from its portion deviating from the coupling beam 4 in a direction away from the fuse engageable portion 9 such that opposite side faces of each of the arms 2 extend rectilinearly in parallel in the fuse engageable portion 9. Thus, in the fuse engageable portion 9, each of the arms 2 has a width w2.

In the grip 10, a plurality of bosses 8 for preventing slip of fingers at the time of pulling the fuse out of a fuse mounting portion 31 (FIG. 8) are formed on each of opposite side faces of the other end portion of each of the arms 2. In the grip 10, a small width portion 18 having a predetermined width w1 which is about 50 to 65% of the width w2 is provided at the other end portion of each of the arms 2. In this embodiment, the width w1 is set to 5 mm, while the width w2 is set to 8 mm. Meanwhile, in the grip 10, a pair of stoppers 15 project towards each other from distal end portions of the arms 2 and a rib 16 extends from each of the stoppers 15 to the coupling beam 4 at a lateral center of an inner face of each of the arms 2 so as to reinforce each of the arms 2 in the grip 10. Furthermore, a plurality of laterally extending bosses 11 are provided at a substantially longitudinally central portion of an outer face of each of the arms 2. In case the fuse mounting portion 31 has large space for using the fuse puller K1, the fuse 25 can be pulled out of the fuse mounting portion 31 by grasping the bosses 11.

The coupling beam 4 is arcuately projected from the fuse engageable portion 9 towards the grip 10 such that the coupling beam 4 and the fuse engageable portion 9 are formed into a substantially U-shaped configuration. Since the coupling beam 4 is formed into the U-shaped configuration as described above and the arms 2 are inclined towards each other at the fuse engageable portion 9, the arms 2 are urged by the elastic coupling beam 4 in a direction for moving the claws 5 and 6 towards each other. A portion of the coupling beam 4, which is coupled with each of the arms 2, is rounded such that stress concentration does not happen at the portion of the coupling beam 4.

Figure 9:
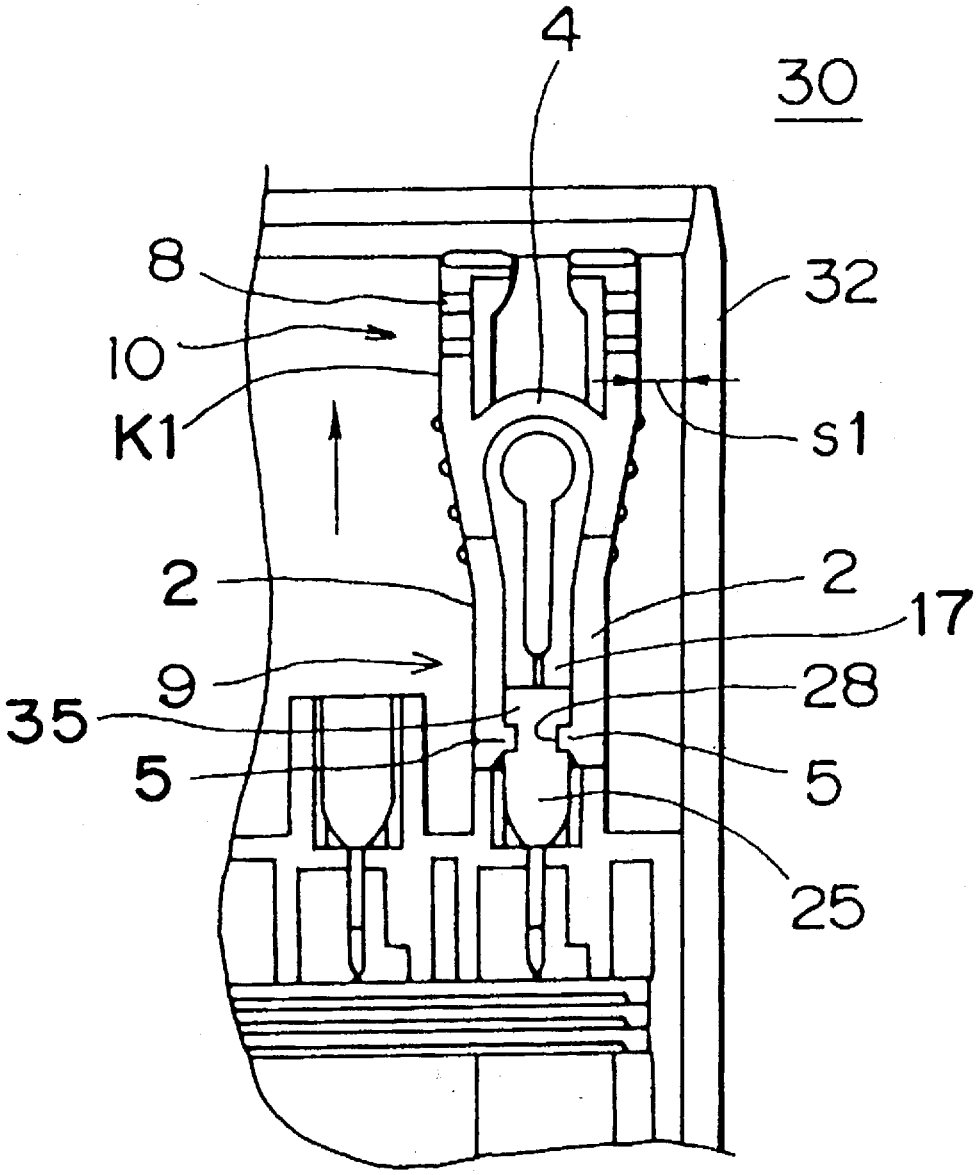
FIG. 9 is a schematic sectional view taken along the line IX—IX in FIG. 8.

The U-shaped rib 7 extends from the inner peripheral surface of the coupling beam 4 at a lateral center of the inner face of each of the arms 2 in the fuse engageable portion 9. A pair of protrusions 17 are, respectively, provided at opposite ends of the rib 7 so as to project towards each other. By providing the rib 7, not only the arms 2 at the fuse engageable portion 9 can be reinforced but the claws 5 and 6 can be strongly urged towards each other. Meanwhile, the protrusions 17 are brought into contact with an upper end face of a fuse body 26 of the fuse 25 such that a portion 35 of the fuse 25, which is disposed between the upper end face of the fuse body 26 and the slots 28, is gripped by the protrusions 17 and the claws 5 and 6 as shown in FIG. 9. Therefore, in addition to engagement of the claws 5 and 6 with the fuse 25, the protrusions 17 serve to fix the fuse puller K1 to the fuse 25 more securely.

The two pairs of the claws 5 and 6 are provided at opposite sides of the inner face of each of the arms 2 at the distal end of each of the arms 2 in the fuse engageable portion 9. A front end of each of the claws 5 and 6 is formed so as to extend obliquely downwardly in a direction away from the coupling beam 4, while rear ends of the claws 5 and 6 extend orthogonally from the inner face of each of the arms 2 so as to act as engageable faces 5*a* and 6*a*, respectively.

Figure 6:
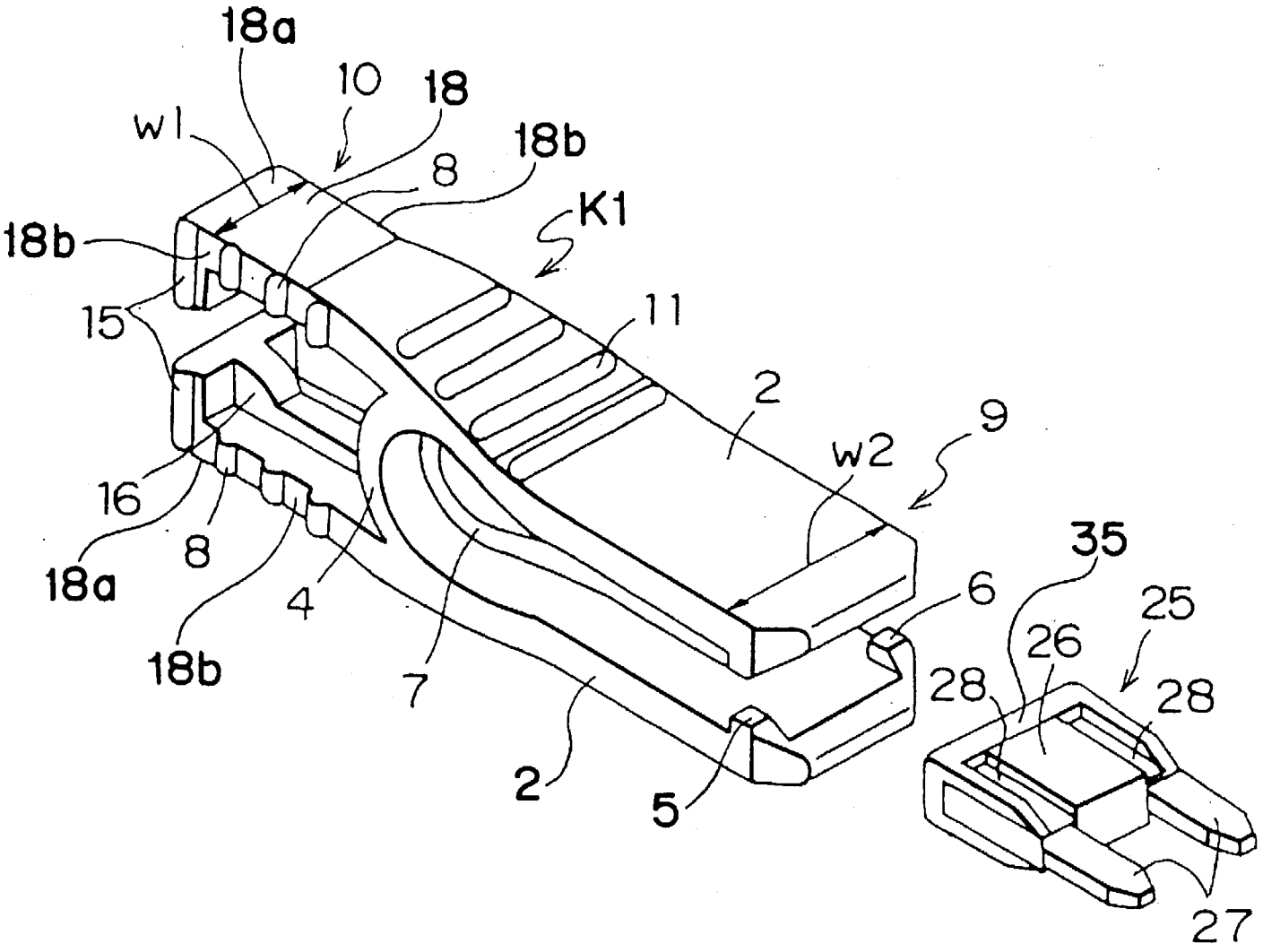
FIG. 6 is a perspective view of a fuse and a fuse puller according to a first embodiment of the present invention.
Figure 7:
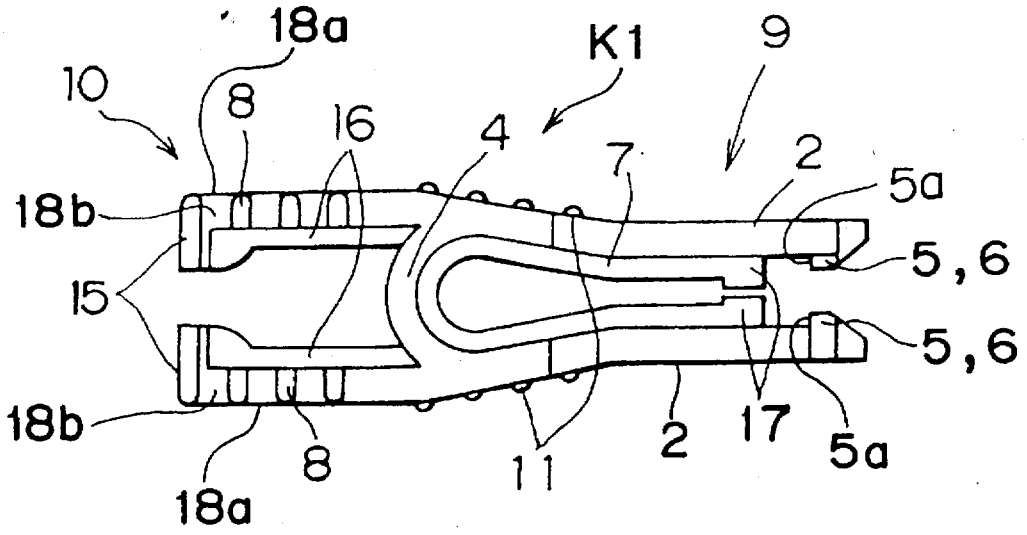
FIG. 7 is a side elevational view of the fuse puller of FIG. 6.

As shown in FIG. 6, the fuse 25 employed in this embodiment is of known shape in general use and includes the fuse body 26 formed by insulating resin and a pair of terminal plates 27. One end portion of each of the terminal plates 27 is embedded in the fuse body 26, while the other end portion of each of the terminal plates 27 projects out of the fuse body 26. A pair of slots 28 are formed at opposite sides of the fuse body 26 so as to receive the claws 5 and 6 of the fuse puller K1.

Figure 8:
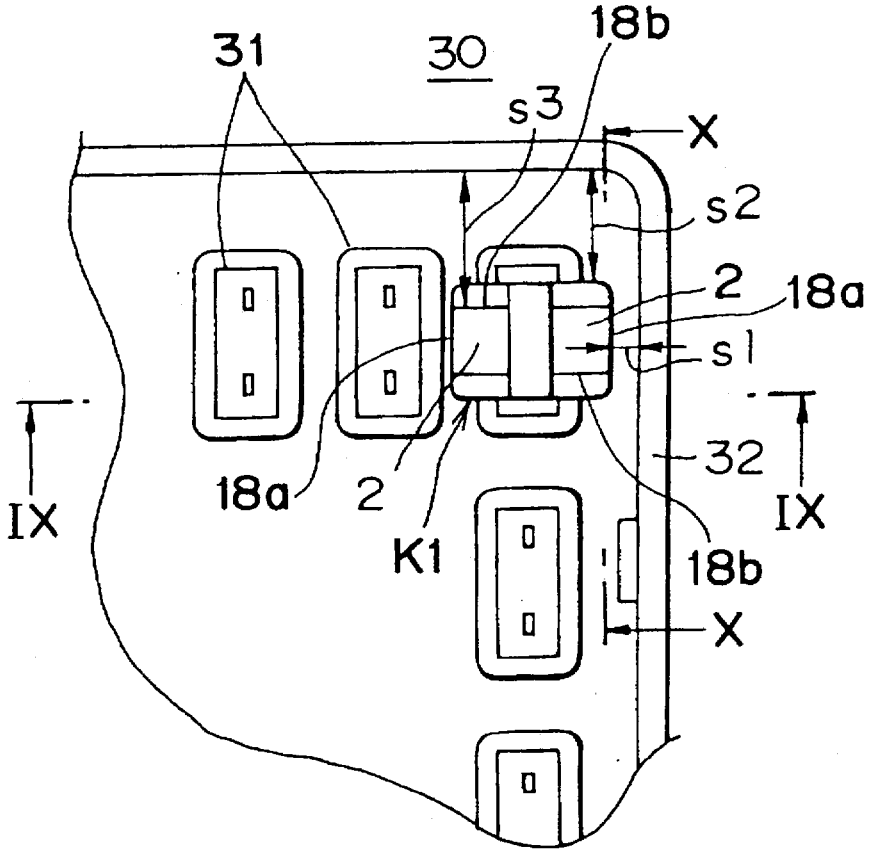
FIG. 8 is a top plan view explanatory of pulling a fuse out of a fuse mounting portion by the fuse puller of FIG. 6.
Figure 10:
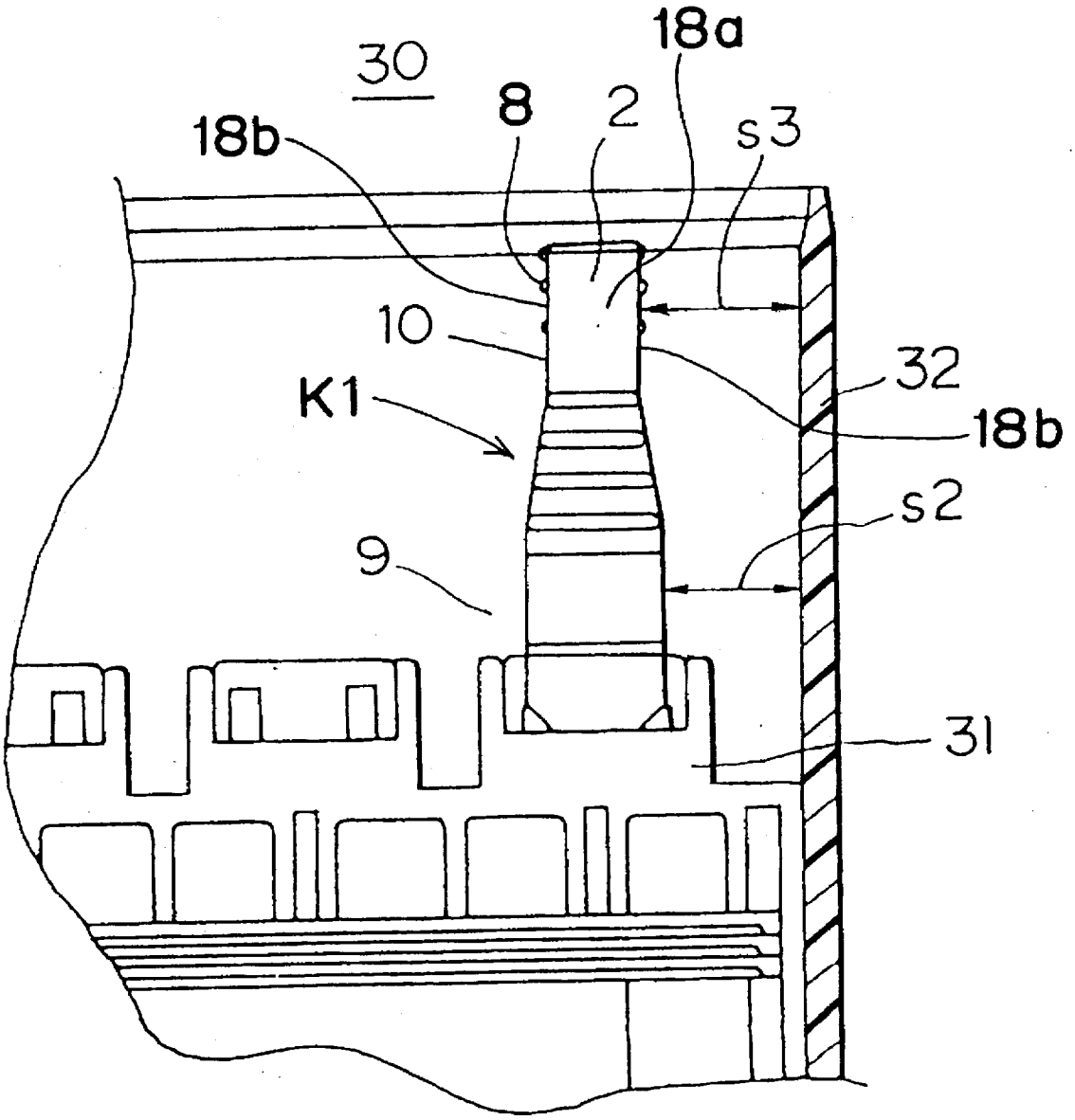
FIG. 10 is a schematic sectional view taken along the line X—X in FIG. 8.

Hereinafter, operation of pulling the fuse 25 out of the fuse mounting portion 31 by using the fuse puller K1 is described. A fuse box 30 shown in FIGS. 8 to 10 are installed in an engine room of a motor vehicle and a plurality of the fuse mounting portions 31 are provided at corners of a side wall 32 of the fuse box 30. The side wall 32 is formed high for waterproofing.

When the fuse 25 is pulled out of the fuse mounting portion 31 by the fuse puller K1, the small width portions 18 disposed at one end of each of the arms 2 in the grip 10 are initially depressed towards each other by grasping opposite outer faces 18*a* of the small width portions 18 of the arms 2 with fingers. Thus, the other ends of the arms 2 at the fuse engageable portion 9 are separated away from each other with the coupling beam 4 as a fulcrum. By grasping the small width portions 18 disposed at one end of each of the arms 2 in the grip 10 as described above, the fuse puller K1 is brought to the fuse 25 inserted into the fuse mounting portion 31. Therefore, the fuse puller K1 can be operated even if gap between the fuse puller K1 and the side wall 32 of the fuse box 30 is small. Since the arms 2 in the fuse engageable portion 9 are separated away from each other, the claws 5 and 6 can be brought into engagement with the slots 28 of the fuse 25. Then, by releasing the grip 10 from depression, the claws 5 and 6 are held in engagement with the slots 28 of the fuse 25, respectively.

Figure 4:
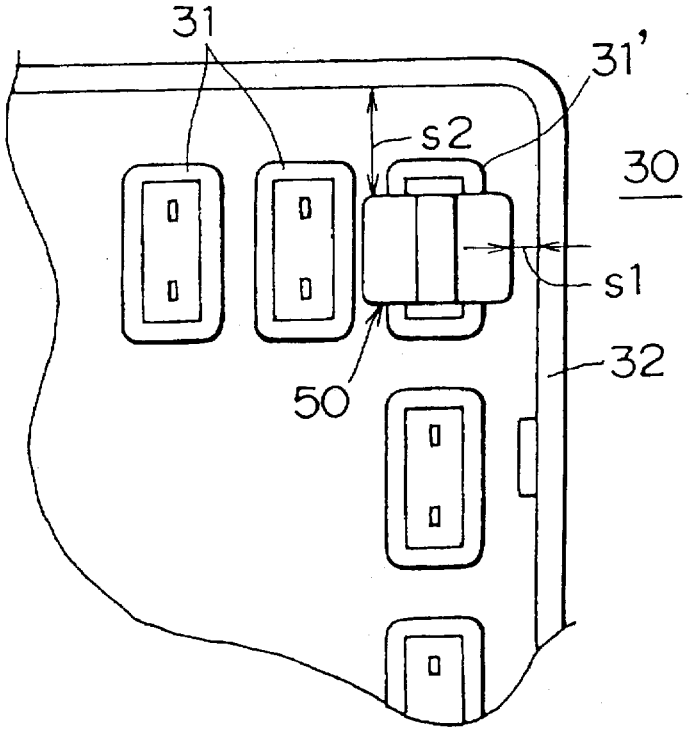
Fig. 4 PRIOR ART
FIG. 4 is a top plan view showing positional relation among fuse mounting portions of a fuse box, a side wall of the fuse box and the prior art fuse puller of FIG. 1 (already referred to)
Figure 5:
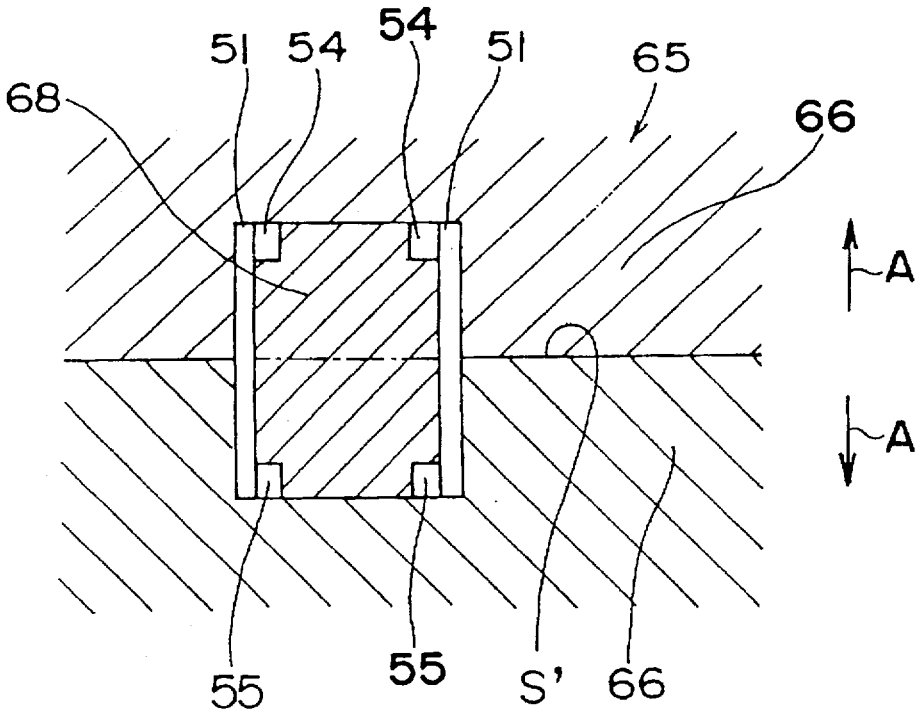
Fig. 5 PRIOR ART
FIG. 5 is a sectional view of a molding die for the prior art fuse puller of FIG. 1 (already referred to)

Subsequently, fingers for holding the fuse puller K1 are shifted through 90° so as to clip opposite side faces 18*b* of each of the small width portions 18 of the arms 2. At this time, the width w1 of the small width portions 18 of the arms 2 is made small. Therefore, as best shown in FIG. 10, a gap s3 between the small width portion 18 of the arm 2 and the side wall 32 of the fuse box 30 becomes larger than a gap s2 between the fuse engageable portion 9 of the arm 2 and the side wall 32, which is obtained in a prior art fuse puller of FIG. 4.

Accordingly, fingers can be easily inserted into the large gap s3. Furthermore, since the bosses 8 are formed on the opposite side faces 18*b* of each of the small width portions 18, the opposite side faces 18*b* of each of the small width portions 18 can be clipped without slip of fingers. By clipping the opposite side faces 18*b* of each of the small width portions 18 as described above, the fuse puller K1 is pulled outwardly.

The bosses 8 are provided on the opposite side faces 18*b* of each of the arms 2, while the claws 5 and 6 are provided on the inner face of each of the arms 2. Therefore, even if the bosses 8 are clipped strongly when the fuse puller K1 is pulled outwardly, the claws 5 and 6 are not separated away from each other. Accordingly, in the course of pulling the fuse puller K1 outwardly, such a phenomenon does not occur that the claws 5 and 6 are separated away from each other and thus, the fuse 25 falls off the fuse puller K1. As a result, the fuse 25 can be pulled out of the fuse mounting portion 31 by positively holding the fuse 25 with the fuse puller K1.

Also when the fuse 25 held by the fuse puller K1 is inserted into the fuse mounting portion 31, the fuse 25 may be inserted into the fuse mounting portion 31 by clipping the bosses 8 in a state where the claws 5 and 6 are held in engagement with the slots 28. In this case, in the course of insertion of the fuse 25 into the fuse mounting portion 31, the fuse 25 does not fall off the fuse puller K1 through disengagement of the claws 5 and 6 from the slots 28 of the fuse 25. In addition, after the fuse 25 has been inserted into the fuse mounting portion 31, fingers for clipping the bosses 8 of the grip 10 of the fuse puller K1 are shifted so as to grasp the opposite outer faces 18*a* of the small width portions 18 of the grip 10 of the fuse puller K1. Then, the opposite outer faces 18*a* of the small width portions 18 of the grip 10 are depressed towards each other so as to separate the claws 5 and 6 away from each other such that the claws 5 and 6 are brought out of engagement with the slots 28. As a result, the fuse puller K1 can be detached from the fuse 25 so as to be taken out of the fuse box 30.

Figure 11:
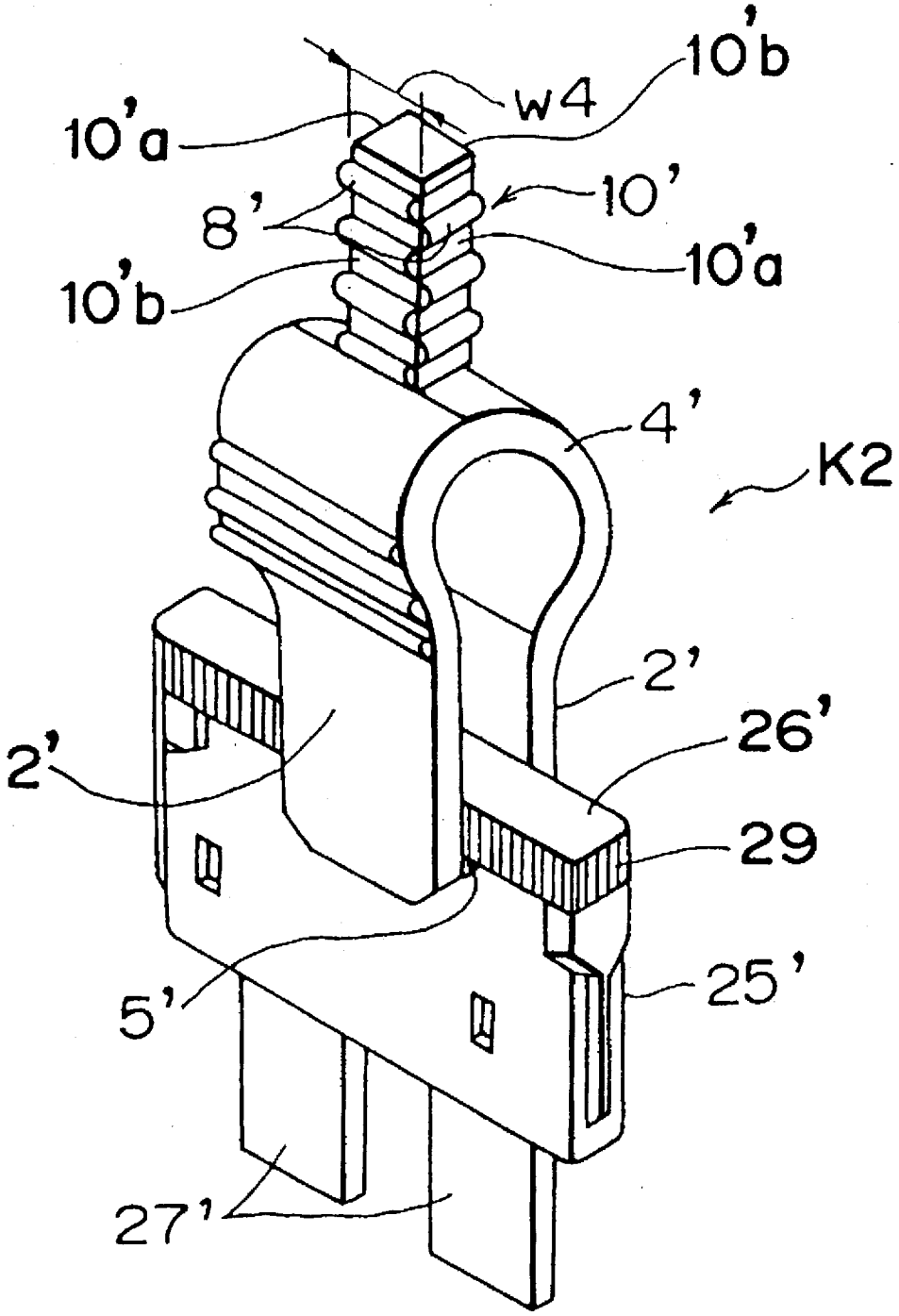
FIG. 11 is a perspective view of a fuse puller according to a second embodiment of the present invention.

FIG. 11 shows a fuse puller K2 according to a second embodiment of the present invention. The fuse puller K2 has a substantially U-shaped configuration and includes a pair of platelike arms 2'. One end of one of the arms 2' and one end of the other of the arms 2' are coupled with each other by an arcuate elastic coupling beam 4'. In the same manner as the fuse puller K1, two pairs of claws 5' and 6' (not shown) for gripping a fuse 25' are projected from the other end of an inner face of each of the arms 2'.

This fuse puller K2 is used exclusively for pulling the fuse 25' out of the fuse mounting portion 31. The fuse 25' includes a pair of terminal plates 27' and a projection 29 provided at an upper end of a fuse body 26'. When the claws 5' and 6' are brought into contact with the projection 29 of the fuse 25', the arms 2' are deflected with the coupling beam 4' as a fulcrum so as to be separated away from each other. When the claws 5' and 6' have ridden over the projection 29, the arms 2' are displaced towards each other by elasticity of the coupling beam 4' such that the claws 5' and 6' are brought into engagement with a lower face of the projection 29.

A rectangular grip 10' having a small width w4 between a pair of opposite side faces 10'*a* projects from a central portion of an outer peripheral surface of the coupling beam 4'. Bosses 8' are formed on four side faces, i.e., the opposite side faces 10' a and another pair of opposite side faces 10'*b* of the grip 10'. Meanwhile, the bosses 8' may also be formed on a pair of the opposite side faces 10'*a* or the opposite side faces 10'*b* of the grip 10', preferably, a pair of the opposite side faces 10'*a*.

When the arms 2' are inserted, by grasping the bosses 8', into the fuse box 30 in order to pull the fuse 25' out of the fuse mounting portion 31, the arms 2' are deflected such that the claws 5' and 6' are brought into engagement with the projection 29. Then, when the fuse puller K1 is pulled outwardly by grasping the bosses 8' of the grip 10', the fuse 25' held in engagement with the claws 5' and 6' of the fuse puller K2 is pulled out of the fuse mounting portion 31.

During pulling of the fuse 25' out of the fuse mounting portion 31, displacements of the fuse puller K2 both for inserting the fuse puller K2 into the fuse box 30 and for pulling the fuse puller K2 out of the fuse box 30 can be performed by grasping the narrow grip 10'. Therefore, even if gap between the fuse mounting portion 31 and the side wall 32 of the fuse box 30 is small, space for inserting fingers thereinto can be secured between the grip 10' of the fuse puller K2 and the side wall 32 of the fuse box 30, so that the fuse 25' can be easily pulled out of the fuse mounting portion 31 by the fuse puller K2 by inserting fingers into the space.

As is clear from the foregoing description of the fuse puller of the first embodiment, width of the grip of the fuse puller is made small. Therefore, even in case gap between the fuse mounting portion and the side wall of the fuse box is small, space for inserting fingers thereinto can be secured between the grip of the fuse puller and the side wall of the fuse box and thus, the fuse can be easily pulled out of the fuse mounting portion by the fuse puller. Furthermore, when the fuse puller is taken out of the fuse box, the opposite side faces of the grip of the fuse puller are clipped in a direction which is not associated with separation of the claws away from each other, so that the fuse does not fall off the fuse puller through disengagement of the claws from the slots of the fuse. Therefore, the fuse can be pulled out of the fuse mounting portion by positively holding the fuse with the fuse puller.

Meanwhile, also in the fuse puller of the second embodiment, since the narrow grip is provided, the fuse can be easily pulled out of the fuse mounting portion even when space between the fuse mounting portion and the side wall of the fuse box is small. Furthermore, the fuse puller can be not only inserted into the fuse box but pulled out of the fuse box by grasping identical side faces of the grip of the fuse puller without the need for shifting grasping position of fingers on the grip as in the first embodiment.

Furthermore, if the bosses are provided on the opposite narrow side faces of each of the arms, fingers do not slip when the fuse is pulled out of the fuse mounting portion by the fuse puller. Moreover, the bosses of the arms enable an operator to immediately perceive grasping position on the fuse puller.

Figure 12:
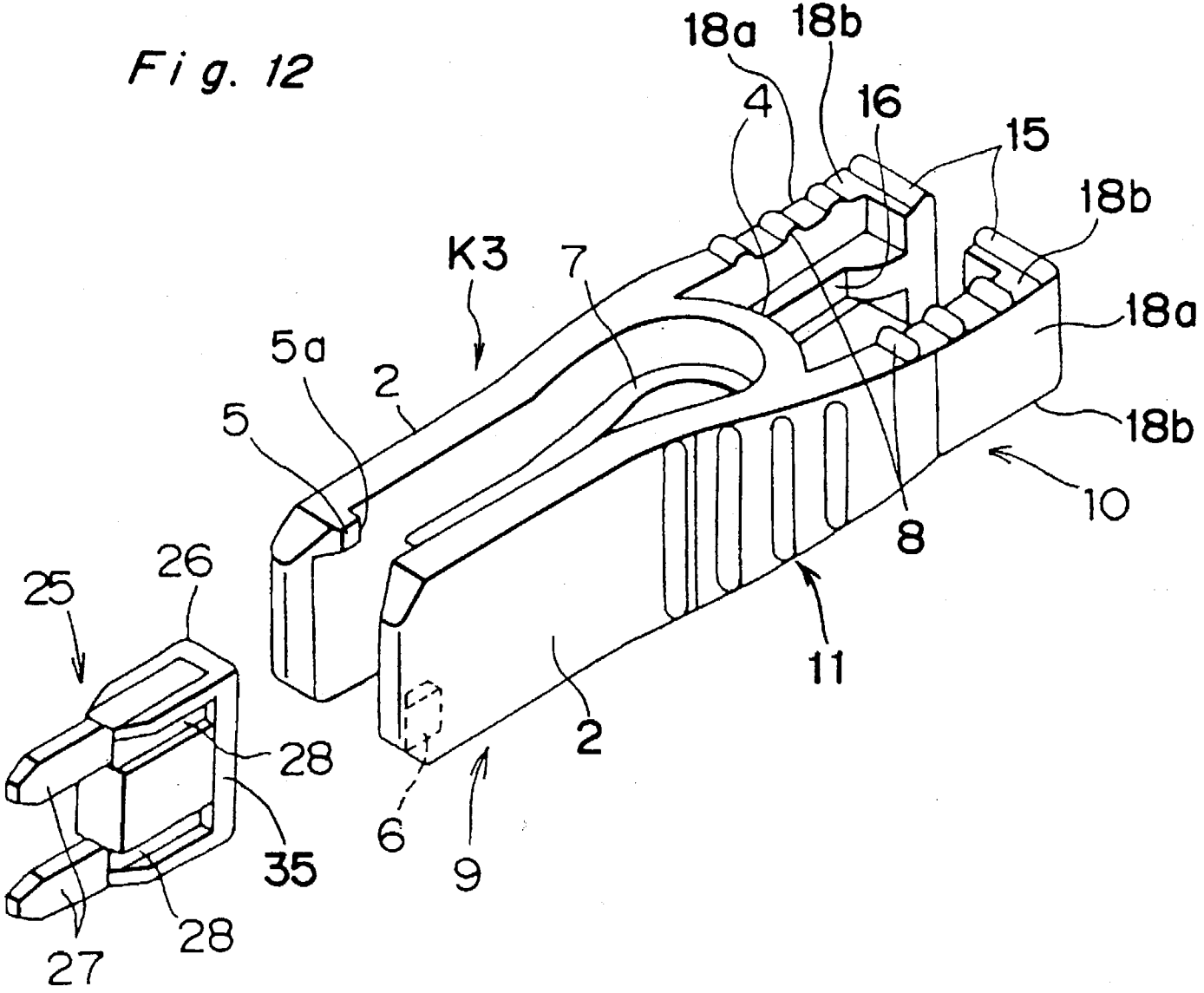
FIG. 12 is a perspective view of a fuse and a fuse puller according to a third embodiment of the present invention.
Figure 13:
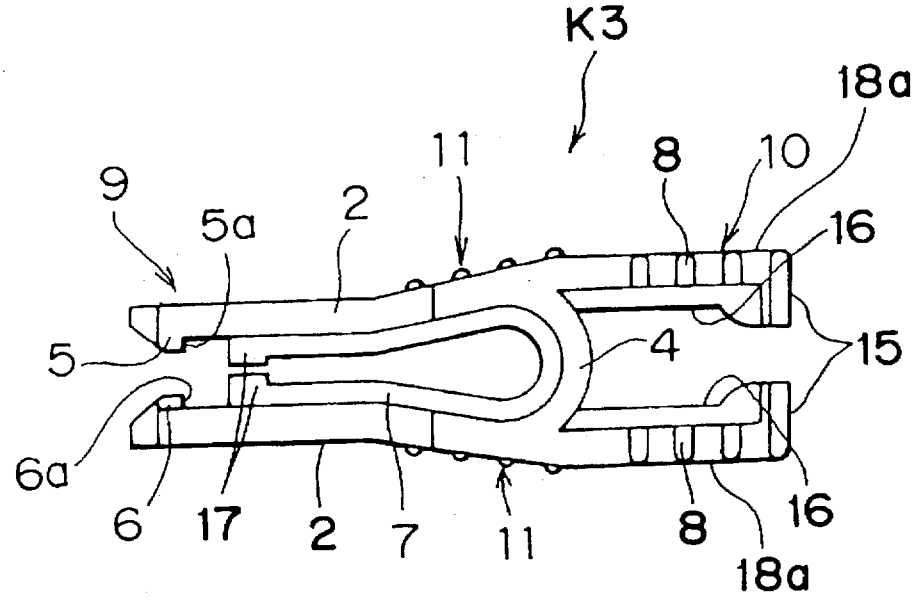
FIG. 13 is a top plan view of the fuse puller of FIG. 12.

FIGS. 12 and 13 show a fuse puller K3 according to a third embodiment of the present invention. In the fuse puller K3, the single claw 5 is provided at one side of one end portion of an inner face of one of the arms 2, while the single claw 6 is provided at the other side of one end portion of an inner face of the other of the arms 2 such that the claws 5 and 6 deviate from each other in a lateral direction of the arms 2. In other words, the claws 5 and 6 are disposed diagonally to each other on the arms 2. Since other constructions of the fuse puller K3 are similar to those of the fuse puller K1, the description is abbreviated for the sake of brevity.

Figure 14:
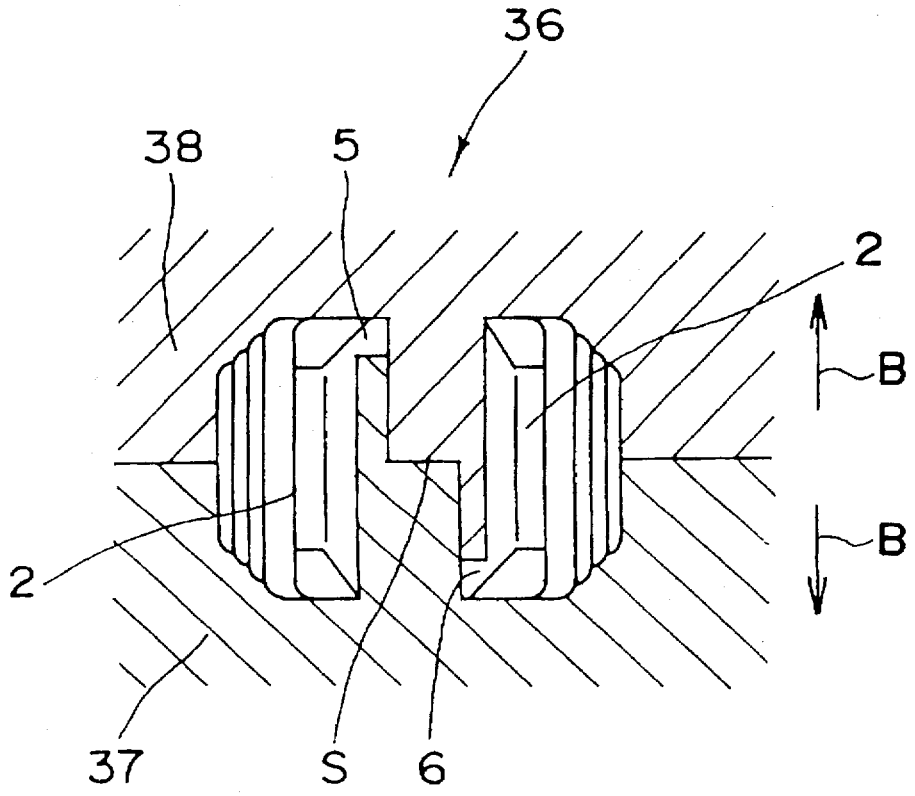
FIG. 14 is a sectional view showing a parting line of a molding die for producing the fuse puller of FIG. 12.

Since the claws 5 and 6 are, respectively, provided at one side of one end portion of the inner face of one of the arms 2 and at the other side of one end portion of the inner face of the other of the arms 2 so as to deviate from each other in the lateral direction of the arms 2 as described above, a die 36 used for injection molding of the fuse puller K3 can be formed by split dies 37 and 38 as shown in FIG. 14. Namely, a parting line S of the split dies 37 and 38 is disposed at a lateral center of the arms 2. In a molding area for the claws 5 and 6 between the arms 2, the split die 37 for the claw 6 traverses the parting line S along a distal end of the claw 6 and penetrates to an inner side of the claw 5, while the split die 38 for the claw 5 traverses the parting line S along a distal end of the claw 5 and penetrates to an inner side of the claw 6. By setting the parting line S of the split dies 37 and 38 as described above, the split dies 37 and 38 can be released from each other in the directions of the arrows B in FIG. 14 and thus, a hitherto necessary sliding die is not required to be provided. Since the die 36 for molding the fuse puller K3 is formed by only the split dies 37 and 38 as described above, molding time for the fuse puller K3 can be shortened, thereby resulting in rise of productivity and drop of production cost of the die 36.

In order to pull the fuse 25 out of the fuse mounting portion 31 by using the fuse puller K3, the opposite outer faces 18*a* of the small width portions 18 of the grip 10 are grasped so as to be depressed towards each other such that distal ends of the arms 2 at the fuse engageable portion 9 are separated away from each other. Thus, the claws 5 and 6 ride over the fuse body 26 of the fuse 25 so as to be brought into engagement with the slots 28. At this time, the claw 5 is brought into engagement with one of the two slots 28 formed on one face of the fuse 25, while the claw 6 is brought into engagement with one of the two slots 28 formed on the other face of the fuse 25 such that the slots 28 receiving the claws 5 and 6, respectively are disposed diagonally to each other in the fuse 25.

Then, by releasing the grip 10 from depression, the claws 5 and 6 are held in engagement with the slots 28. In this state, the fuse puller K3 is pulled outwardly. At this time, since the claws 5 and 6 disposed diagonally to each other are held in engagement with the slots 28 of the fuse 25, the fuse 25 can be pulled out of the fuse mounting portion 31 stably.

The fuse puller K3 has the only two claws 5 and 6. Therefore, in comparison with the four claws of the fuse puller K1, force of engagement of the claws with the slots in the fuse puller K3 is reduced to half of that of the fuse puller K1 on the assumption that the claws in the fuse pullers K1 and K2 have an identical shape. However, since the U-shaped rib 7 extends from the coupling beam 4 towards the claws 5 and 6 and urging force oriented in a direction for moving the claws 5 and 6 towards each other is applied from the coupling beam 4 to the rib 7, the claws 5 and 6 are urged in a direction for bringing the claws 5 and 6 into engagement. Therefore, even if the number of the claws in the fuse puller K3 is only two, force of engagement of the claws with the slots in the fuse puller K3 is large such that reduction of the number of the claws in the fuse puller K3 is compensated for.

It is needless to say that by holding the fuse 25 with the fuse puller K3, the fuse puller K3 can be used for inserting the fuse 25 into the fuse mounting portion 31.

In the fuse puller K3, since the first claw is provided at one side of the one end portion of the inner face of one of the arms and the second claw is provided at the other side of the one end portion of the inner face of the other of the arms such that the first and second claws deviate from each other in the lateral direction of the arms. Therefore, a hitherto necessary sliding die is not required to be used for the die for molding the fuse puller, which has the parting line at the lateral center of the arms. As a result, molding time can be shortened and production cost of the die can be reduced.

Meanwhile, if the U-shaped rib is formed on the inner faces of the arms so as to extend from the coupling beam towards the claws, force of engagement of the claws with the slots of the fuse can be increased by the rib. Furthermore, if the protrusions are provided at the opposite ends of the rib, respectively so as to project towards each other such that the portion of the fuse disposed between the upper end face of the fuse body and the slots is gripped by the protrusions and the claws, force for holding the fuse by the fuse puller is further increased. Accordingly, when the fuse is pulled out of the fuse mounting portion by using the fuse puller, drop of the holding force of the fuse puller due to reduction of the number of the claws can be compensated for.

What is claimed is:

1. A fuse puller for pulling a fuse out of a fuse mounting portion, which is integrally molded by resin and comprises:

a pair of elongated platelike arms;

an elastic coupling beam for coupling longitudinally intermediate portions of the arms with each other;

only a single claw which projects from one side of one end of an inner face of one of the arms so as to be brought into engagement with the fuse; and only a single claw which projects from the other side of one end of an inner face of the other of the arms so as to be brought into engagement with the fuse such that the said only claw of said one side and said only claw of said other side are disposed diagonally to each other.

2. A fuse puller as claimed in claim 1, wherein the coupling beam is shaped arcuately and a U-shaped rib is formed so as to extend at a lateral center of an inner face of each of the arms from an inner peripheral surface of the coupling beam towards the first and second claws.

3. A fuse puller as claimed in claim 2, wherein a pair of protrusions are, respectively, provided at opposite ends of the rib so as to project towards each other such that a portion of the fuse is gripped by the protrusions and the first and second claws.

* * * * *